US009053873B2

(12) United States Patent
Rogers et al.

(10) Patent No.: US 9,053,873 B2
(45) Date of Patent: Jun. 9, 2015

(54) SWITCHES FOR USE IN MICROELECTROMECHANICAL AND OTHER SYSTEMS, AND PROCESSES FOR MAKING SAME

(71) Applicant: HARRIS CORPORATION, Melbourne, FL (US)

(72) Inventors: John E. Rogers, Vero Beach, FL (US); Michael R. Weatherspoon, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 399 days.

(21) Appl. No.: 13/623,188

(22) Filed: Sep. 20, 2012

(65) Prior Publication Data

US 2014/0076698 A1 Mar. 20, 2014

(51) Int. Cl.

| | |
|---|---|
| ***H01H 57/00*** | (2006.01) |
| ***H01H 1/00*** | (2006.01) |
| ***H01H 59/00*** | (2006.01) |

(52) U.S. Cl.

CPC ..... *H01H 1/0036* (2013.01); *H01H 57/00* (2013.01); *H01H 59/0009* (2013.01)

(58) Field of Classification Search

CPC ..... H01H 57/00; H01H 2205/00; H01H 2205/004; H01H 2235/006; H01H 2237/004; H01H 2036/00

USPC ..... 200/181; 335/78

See application file for complete search history.

(56) References Cited

U.S. PATENT DOCUMENTS

| | | | |
|---|---|---|---|
| 4,670,724 | A | 6/1987 | Riblet et al. |
| 5,025,264 | A | 6/1991 | Stafford |

(Continued)

FOREIGN PATENT DOCUMENTS

| | | | |
|---|---|---|---|
| DE | 102010034525 | A1 | 2/2011 |
| EP | 0849820 | A2 | 6/1998 |

(Continued)

OTHER PUBLICATIONS

Information about Related Patents and Patent Applications, see section 6 of the accompanying Information Disclosure Statement Letter, which concerns Related Patents and Patent Applications. Jan. 17, 2013.

(Continued)

*Primary Examiner* — Edwin A. Leon

*Assistant Examiner* — Anthony R. Jimenez

(74) *Attorney, Agent, or Firm* — Robert J. Sacco, Esq.; Fox Rothschild LLP

(57) ABSTRACT

Embodiments of switches (10) include electrically-conductive housings (30, 60), and electrical conductors (34, 64) suspended within and electrically isolated from the housings (30, 60). Another electrical conductor (52) is configured to move between a first position at which the electrical conductor (52) is electrically isolated from the electrical conductors (34, 64) within the housings (30, 60), and a second position at which the electrical conductor (52) is in electrical contact with the electrical conductors (34, 64) within the housings (30, 60). The switches (10) further include an actuator (70, 72, 74, 76) comprising an electrically-conductive base (80) and an electrically-conductive arm (82*a*, 82*b*) having a first end restrained by the base (80). The electrical conductor (52) is supported by the arm (82*a*, 82*b*), and the arm (82*a*, 82*b*) is operative to deflect and thereby move the electrical conductor (52) between its first and second positions.

20 Claims, 13 Drawing Sheets

(56) References Cited

U.S. PATENT DOCUMENTS

| | | | | |
|---|---|---|---|---|
| 6,384,353 | B1 | 5/2002 | Huang et al. | |
| 6,587,021 | B1 | 7/2003 | Streeter | |
| 6,600,395 | B1 | 7/2003 | Handforth et al. | |
| 6,812,718 | B1 | 11/2004 | Chong et al. | |
| 6,822,532 | B2 | 11/2004 | Kane et al. | |
| 7,012,489 | B2 | 3/2006 | Sherrer et al. | |
| 7,026,899 | B2 | 4/2006 | Adams et al. | |
| 7,123,119 | B2 | 10/2006 | Pashby et al. | |
| 7,259,640 | B2 | 8/2007 | Brown et al. | |
| 7,898,356 | B2 | 3/2011 | Sherrer et al. | |
| 8,354,902 | B2 * | 1/2013 | Kawabata et al. | 335/78 |
| 2004/0066338 | A1 | 4/2004 | Chen et al. | |
| 2004/0166603 | A1 | 8/2004 | Carley | |
| 2004/0189530 | A1 | 9/2004 | Chung et al. | |
| 2005/0001701 | A1 | 1/2005 | Shirakawa | |
| 2005/0067292 | A1 | 3/2005 | Thompson et al. | |
| 2005/0073380 | A1 | 4/2005 | Howell et al. | |
| 2005/0116788 | A1 | 6/2005 | Matters-Kammerer et al. | |
| 2005/0161753 | A1 | 7/2005 | Huff et al. | |
| 2005/0190019 | A1 | 9/2005 | Metz | |
| 2007/0018761 | A1 | 1/2007 | Yamanaka et al. | |
| 2008/0142347 | A1 | 6/2008 | Lewis et al. | |
| 2008/0164542 | A1 | 7/2008 | Yang et al. | |
| 2010/0277259 | A1 | 11/2010 | Ahn et al. | |
| 2011/0220472 | A1 | 9/2011 | Masuda et al. | |
| 2012/0175715 | A1 | 7/2012 | Hammond et al. | |
| 2013/0140165 | A1 | 6/2013 | Lin et al. | |

FOREIGN PATENT DOCUMENTS

| | | | |
|---|---|---|---|
| EP | 1515390 | A1 | 3/2005 |
| EP | 1713144 | A1 | 10/2006 |
| EP | 1939974 | A1 | 7/2008 |
| EP | 2546920 | A1 | 1/2013 |
| ES | 2191642 | | 9/2003 |
| WO | 03/049514 | A2 | 6/2003 |
| WO | 2004/079795 | A2 | 9/2004 |
| WO | 2011/111274 | A1 | 9/2011 |

OTHER PUBLICATIONS

International Search Report and Written Opinion dated Dec. 20, 2013 issued in International Appln. No. PCT/US2013/056368 (12 pages).
International Search Report and Written Opinion dated Jan. 16, 2014 issued in International Appln. No. PCT/US2013/06443 (12 pages).
International Search Report and Written Opinion mailed Jan. 31, 2014 in International Patent Appln. No. PCT/US2013/065405 to Harris Corporation (9 pages).
International Search Report and Written Opinion mailed Nov. 28, 2013 for Interational Patent Appln. No. PCT/US2013/056316 to Harris Corporation (11 pages).
Lau, N.U.and Sloan, R., Suspended Microstrip Patch Antenna With Ground-shield Tapered Suspended Stripline Feed, 33rd European Microwave Conference, Munich 2003, 1385-1387.
International Preliminary Report on Patentability dated Mar. 24, 2015 issued in International Appln. No. PCT/US2013/060814 (8 pages).
International Preliminary Report on Patentability dated Mar. 24, 2015 issued in International Appin. No. PCT/US2013/060817 (8 pages).

* cited by examiner

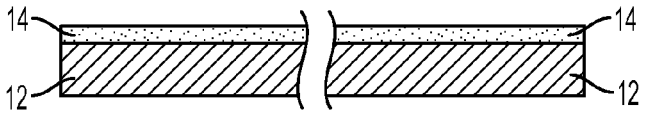
FIG. 9A/9B
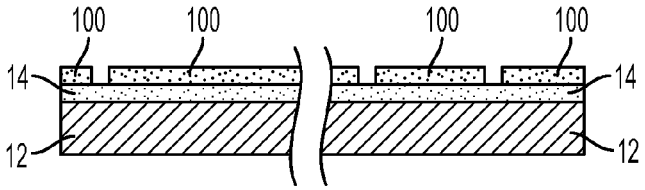
FIG. 10A/10B
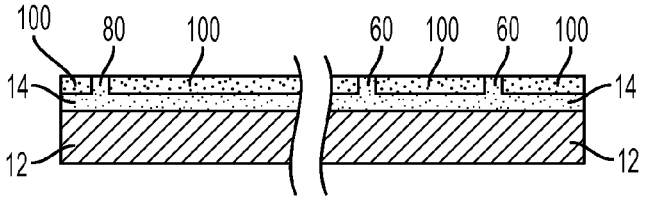
FIG. 11A/11B
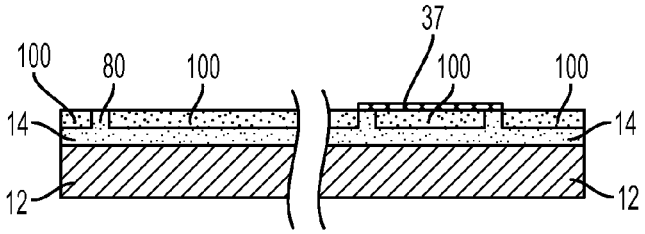
FIG. 12A/12B

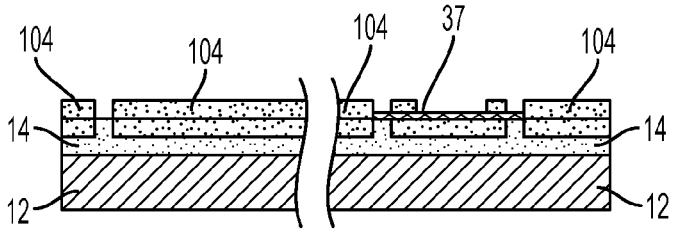
FIG. 13A/13B
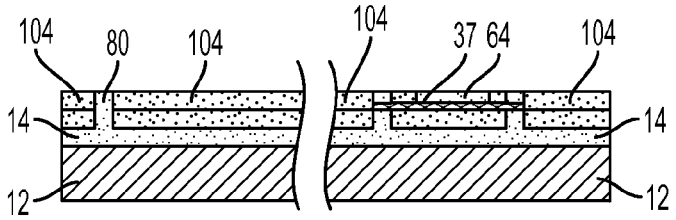
FIG. 14A/14B
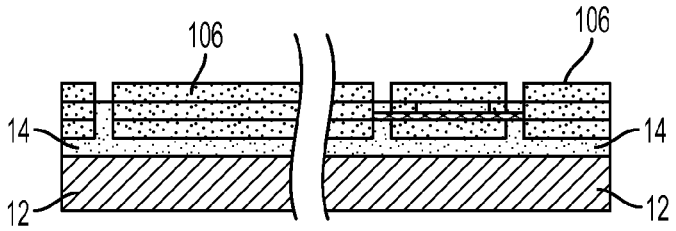
FIG. 15A/15B
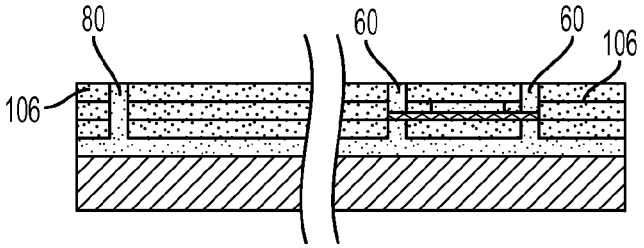
FIG. 16A/16B

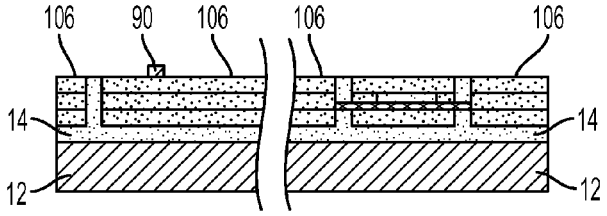
FIG. 17A/17B
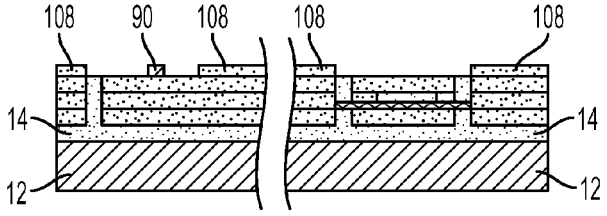
FIG. 18A/18B
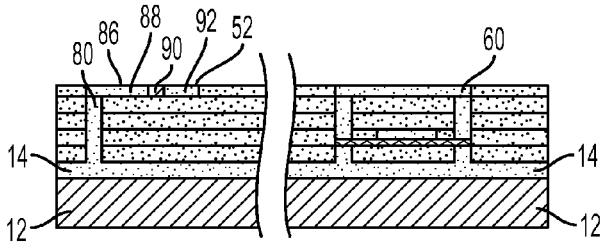
FIG. 19A/19B
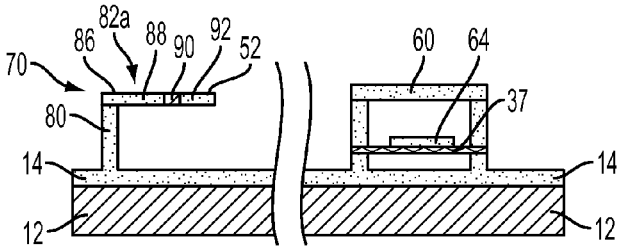
FIG. 20A/20B

SWITCHES FOR USE IN MICROELECTROMECHANICAL AND OTHER SYSTEMS, AND PROCESSES FOR MAKING SAME

BACKGROUND OF THE INVENTION

1. Statement of the Technical Field

The inventive arrangements relate to switches, such as broad-band cantilever microelectromechanical systems (MEMS) switches.

2. Description of Related Art

Communications systems, such as broadband satellite communications systems, commonly operate at anywhere from 300 MHz (UHF band) to 300 GHz (mm-wave band). Such examples include TV broadcasting (UHF band), land mobile (UHF band), global positioning systems (GPS) (UHF band), meteorological (C band), and satellite TV (SHF band). Most of these bands are open to mobile and fixed satellite communications. Higher frequency bands typically come with larger bandwidths, which yield higher data rates. Switching devices used in these types of systems need to operate with relatively low losses, e.g., less than one decibel (dB) of insertion loss, at these ultra-high frequencies.

Miniaturized switches such as monolithic microwave integrated circuit (MMIC) and MEMS switches are commonly used in broadband communications systems due to stringent size constraints imposed on the components of such systems, particularly in satellite-based applications. Currently, the best in class switches operate at 20 GHz with cumulative attributes such as insertion losses of approximately 0.8 dB, return losses of approximately 17 dB, and isolation levels of approximately 40 dB.

Three-dimensional microstructures can be formed by utilizing sequential build processes. For example, U.S. Pat. Nos. 7,012,489 and 7,898,356 describe methods for fabricating coaxial waveguide microstructures. These processes provide an alternative to traditional thin film technology, but also present new design challenges pertaining to their effective utilization for advantageous implementation of various devices such as miniaturized switches.

SUMMARY OF THE INVENTION

Embodiments of switches include an electrically-conductive ground housing, and a first electrical conductor suspended within and electrically isolated from the ground housing. The switches further include an electrically-conductive second housing, and a second electrical conductor suspended within and electrically isolated from the second housing. The switches also have a third electrical conductor configured to move between a first position at which the third electrical conductor is electrically isolated from the first and second electrical conductors, and a second position at which the third electrical conductor is in electrical contact with the first and second electrical conductors. The switches further include an actuator comprising an electrically-conductive base and an electrically-conductive arm having a first end restrained by the base. The third electrical conductor is supported by the arm, and the arm is operative to deflect and thereby move the third electrical conductor between the first and second positions.

BRIEF DESCRIPTION OF THE DRAWINGS

Embodiments will be described with reference to the following drawing figures, in which like numerals represent like items throughout the figures and in which:

FIGS. 9A, 10A, 11A, 12A, 13A, 14A, 15A, 16A, 17A, 18A, 19A, and 20A are cross-sectional views, taken through the line "E-E" of FIG. 1, depicting portions the switch shown in FIGS. 1-8 during various stages of manufacture; and FIGS. 9B, 10B, 11B, 12B, 13B, 14B, 15B, 16B, 17B, 18B, 19B, and 20B are cross-sectional views, taken through the line "F-F" of FIG. 1, depicting portions the switch shown in FIGS. 1-8 during various stages of manufacture.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The figures depict a MEMS switch 10. The switch 10 can selectively establish and disestablish electrical contact between a first electronic component (not shown), and four other electronic components (also not shown) electrically connected to the switch 10. The switch 10 has a maximum height ("z" dimension) of approximately 1 mm; a maximum width ("y" dimension) of approximately 3 mm; and a maximum length ("x" dimension) of approximately 3 mm. The switch 10 is described as a MEMS switch having these particular dimensions for exemplary purposes only. Alternative embodiments of the switch 10 can be scaled up or down in accordance with the requirements of a particular application can be scaled up or down in accordance with the requirements of a particular application, including size, weight, and power (SWaP) requirements.

Figure 1:
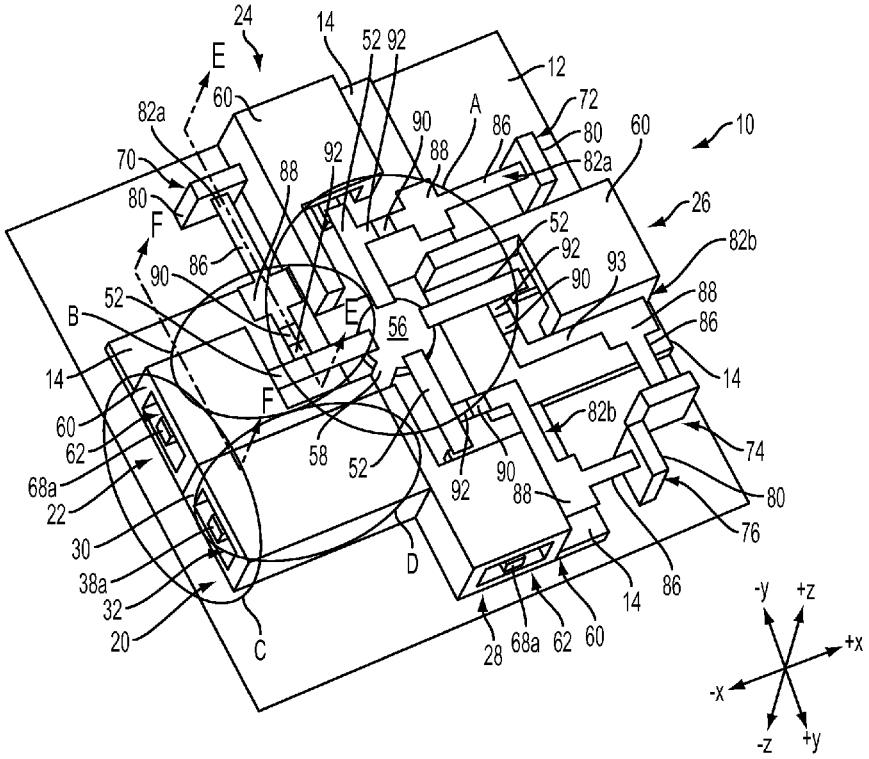
FIG. 1 is a top perspective view of a MEMS switch, depicting contact tabs of the switch in their respective open positions.
Figure 8:
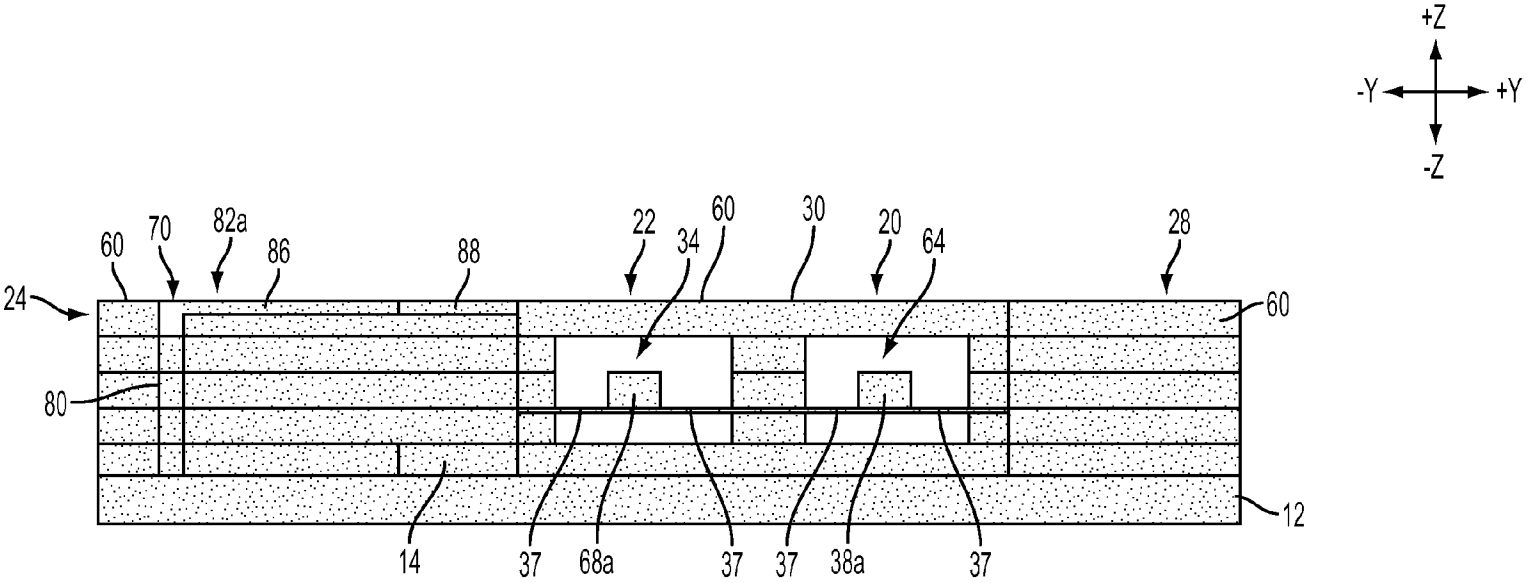
FIG. 8 is a side view of the switch shown in FIGS. 1-7, depicting the layered structure of the switch.

The switch 10 comprises a substrate 12 formed from a dielectric material such as silicon (Si), as shown in FIGS. 1 and 8. The substrate 12 can be formed from other materials, such as glass, silicon-germanium (SiGe), or gallium arsenide (GaAs), in alternative embodiments. The switch 10 also includes a ground plane 14 disposed on the substrate 12. The switch 10 can be formed from five layers of an electrically-conductive material such as copper (Cu). Each layer can have a thickness of, for example, approximately 50 μm. The ground plane 14 is part of a first or lowermost layer of the electrically-conductive material. The number of layers of the electrically-conductive material is applicant-dependent, and can vary with factors such as the complexity of the design, hybrid or monolithic integration of other devices, the overall height ("z" dimension) of the switch 10, the thickness of each layer, etc.

The switch 10 comprises an input port 20. The input port 20 can be electrically connected to a first electronic device (not shown). The switch 10 also comprises a first output port 22; a second output port 24; a third output port 26; and a fourth output port 28, as shown in FIG. 1. The first, second, third, and fourth output ports 22, 24, 26, 28 can be electrically connected to respective second, third, fourth, and fifth electronic devices (not shown). As discussed below, the input port 20 is electrically connected to the first, second, third, and fourth output ports 22, 24, 26, 28 on a selective basis via an electrically-conductive hub 50, and via electrical conductors in the form of contact tabs 52 that move into and out of contact with the hub 50 and portions of the respective first, second, third, and fourth output ports 22, 24, 26, 28.

Figure 2:
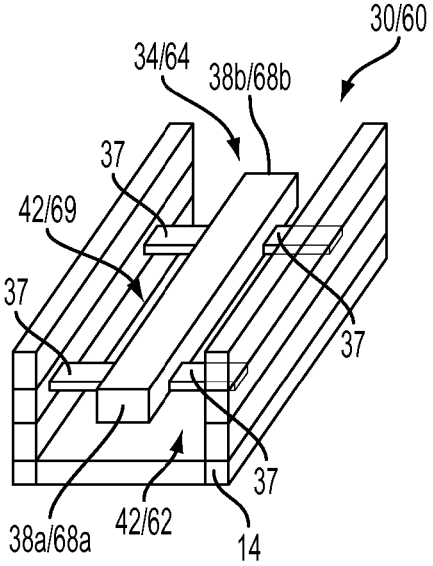
FIG. 2 is a top perspective view of a ground housing of the switch shown in FIG. 1, with a top layer of the housing not shown, for clarity of illustration.

The input port 20 comprises a ground housing 30 disposed on the ground plane 14. The ground housing 30 is formed from portions of the second through fifth layers of the electrically-conductive material, as shown in FIGS. 2 and 8. The ground housing 30 has a substantially rectangular shape when viewed from above. The ground housing 30 and the underlying portion of the ground plane 14 define a first internal channel 32 that extends substantially in the "x" direction, as depicted in FIG. 2.

The input port 20 further includes an electrically-conductive inner conductor 34 having a substantially rectangular cross section. The inner conductor 34 is formed as part of the third layer of the electrically-conductive material. The inner conductor 34 is positioned within the channel 32, as shown in FIGS. 2 and 5-8. A first end 38*a* of the inner conductor 34 is positioned at a first end of the channel 32. A second end 38*b* of the inner conductor 34 is positioned at a second end of the channel 32. Methods for hybrid integration include wire-bonding and flip-chip bonding.

The inner conductor 34 is suspended within the channel 32 on electrically-insulative tabs 37, as illustrated in FIG. 2. The tabs 37 are formed from a dielectric material such as polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the switch 10 as discussed below. The tabs 37 can each have a thickness of, for example, approximately 15 μm. Each tab 37 spans a width, i.e., x-direction dimension, of the channel 32. The ends of each tab 37 are sandwiched between portions of second and third layers of electrically-conductive material that form the sides of the ground housing 30. The inner conductor 34 is surrounded by, and is spaced apart from the interior surfaces of the ground housing 30 by an air gap 42. The air gap 42 acts as a dielectric that electrically isolates the inner conductor 34 from the ground housing 30. The type of transmission-line configuration is commonly referred to as a "recta-coax" configuration, otherwise known as micro-coax.

Figure 7:
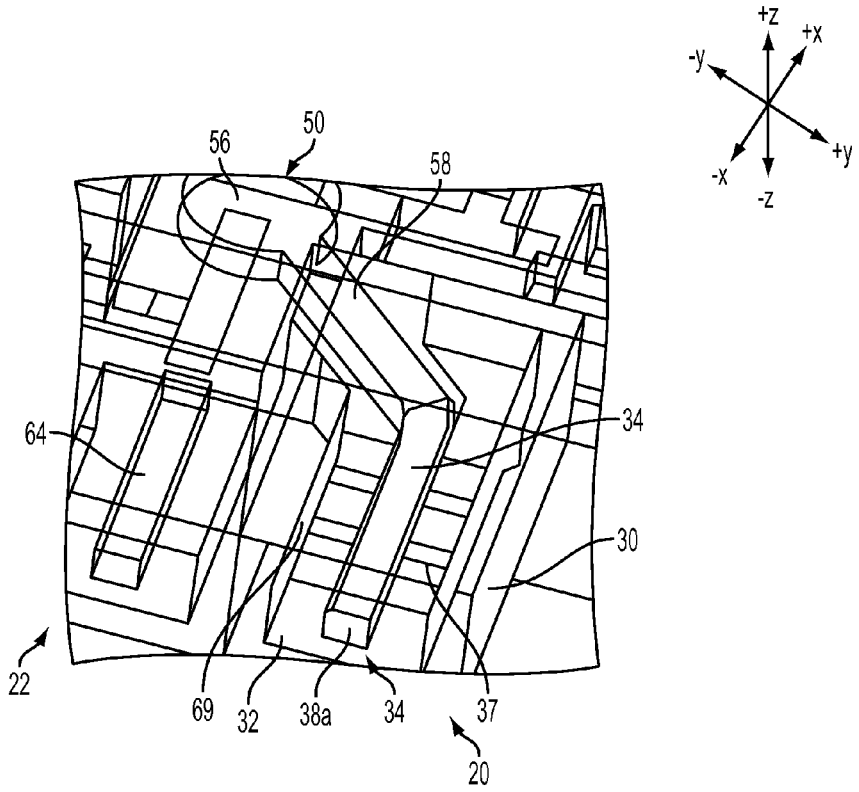
FIG. 7 is a magnified view of the area designated "D" in FIG. 1.

The hub 50 comprises a substantially cylindrical contact portion 56, and a transition portion 58 that adjoins and extends from the contact portion 56, as depicted in FIGS. 1 and 7. The hub 50 is disposed on the substrate 12, and is formed from portions of the first, second, and third layers of electrically-conductive material. The portion of the hub 50 corresponding to the first layer of electrically-conductive material is electrically isolated from the ground plane 14. The contact portion 56 is also formed from a portion of the third layer of electrically-conductive material. The contact portion 56 adjoins, and is thus permanently connected to, the first inner conductor 34 of the input port 20 via the transition portion 58 as shown in FIG. 7.

The first, second, third, and fourth outputs port 22, 24, 26, 28 are substantially identical. The following description of the first output port 22, unless otherwise noted, thus applies equally to the second, third, and fourth output ports 24, 26, 28.

The first output port 22 comprises a ground housing 60 disposed on the ground plane 14. The ground housing 60 adjoins the ground housing 30 of the input port 20. The ground housing 60 is formed from portions of the second through fifth layers of the electrically-conductive material. The ground housing 60 is substantially L-shaped when viewed from above, as shown in FIG. 1. The ground housing 60 and the underlying portion of the ground plane 14 define an internal channel 62 that extends substantially in the "x" direction, as depicted in FIG. 2.

The first output port 22 further includes an electrically-conductive inner conductor 64 having a substantially rectangular cross section. The inner conductor 64 is formed as part of the third layer of the electrically-conductive material. The inner conductor 64 is positioned within the channel 62, as shown in FIG. 2. A first end 68*a* of the inner conductor 64 is positioned at a first end of the channel 62. A second end 68*b* of the inner conductor 64 is positioned at a second end of the channel 62.

The inner conductor 64 is suspended within the channel 62 on electrically-insulative tabs 37, in a manner substantially identical to the inner conductor 34 of the input port 20, as depicted in FIG. 2. The inner conductor 64 is surrounded by, and is spaced apart from the interior surfaces of the ground housing 60 by an air gap 62. The air gap 62 acts as a dielectric that electrically isolates the inner conductor 64 from the ground housing 60.

The second output port 24 has an orientation that is substantially perpendicular to that of the first output port 22, as shown in FIG. 1. The third output port 26 has an orientation that is substantially opposite to that of the first output port 22. The fourth output port 28 has an orientation that is substantially opposite that of the second output port 24.

The switch 10 further comprises a first actuator 70; a second actuator 72; a third actuator 74; and a fourth actuator 76. The first, second, third, and fourth actuators 70, 72, 74, 76 are associated with the respective first, second, third, and fourth output ports 22, 24, 26, 28. The first, second, third, and fourth actuators 70, 72, 74, 76 are substantially similar. The following description of the first actuator 70 applies also to the second, third, and fourth actuators 72, 74, 76, except where otherwise indicated.

The first actuator 70 comprises an electrically-conductive base 80 disposed on the substrate 12, as shown in FIGS. 1 and 8. The first actuator 70 further comprises an arm 82*a*. The arm 82*a* includes an electrically-conductive first portion 86 that adjoins the base 80, and an electrically-conductive second portion 88 that adjoins the first portion 86, as illustrated in FIGS. 1 and 4A-5B. The arm 82*a* further includes an electrically-insulative third portion 90 that adjoins the second portion 88, and an electrically-conductive fourth portion 92. A first end of the fourth portion 92 adjoins the third portion 90. A second end of the fourth portion 92 adjoins the contact tab 52 associated with the first output port 22, at a position on the contact tab 52 between the first and second ends thereof. The arm 82*a* thus is configured as a cantilevered beam, with the contact tab 52 disposed at the freestanding end of the arm 82*a*, and the other end of the arm 82*a* being constrained by the base 80. The configuration of the arm portions 82*a* is application-dependent, and is not limited to that depicted in FIG. 1.

Figure 3A:
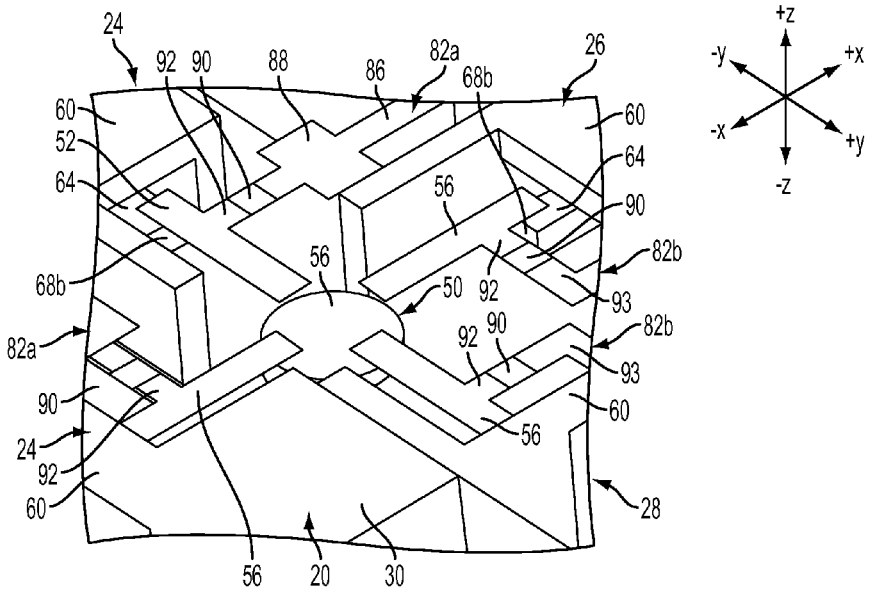
FIG. 3A is a magnified view of the area designated "A" in FIG. 1, depicting the contact tabs in their respective open positions.
Figure 4A:
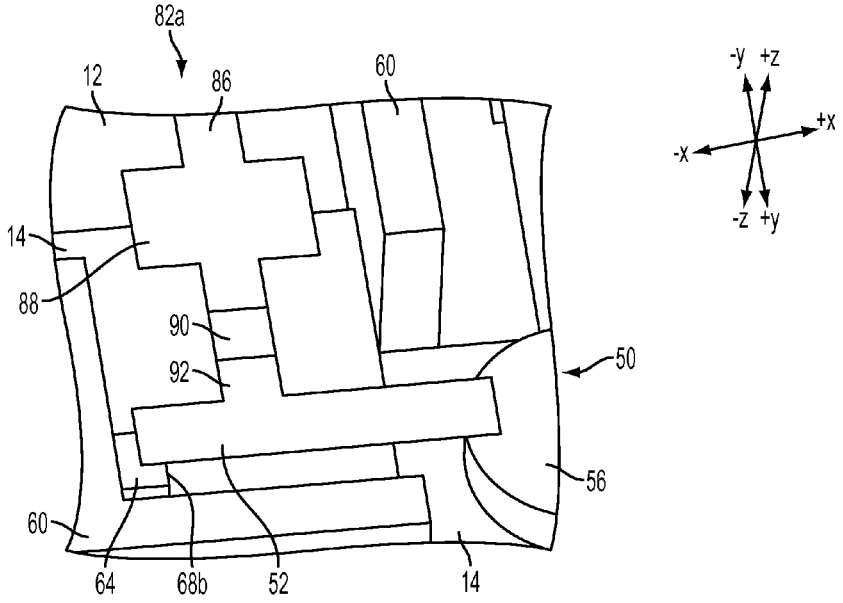
FIG. 4A is a magnified view of the area designated "B" in FIG. 1, depicting one of the contact tabs in its open position.

The first actuator 70 moves the contact tab 52 between an open and a closed position. The first end of the contact tab 52 is spaced apart from the upper surface of the contact portion 56 of the hub 50 when the contact tab 52 is in the open position, as depicted in FIGS. 3A and 4A. The second end of the contact tab 52 likewise is spaced apart from the upper surface of the inner conductor 64 of the first output port 22 when the contact tab 52 is in the open position. The air in the gap between the contact tab 52 and the hub 50 electrically isolates the contact tab 52 from the hub 50. The air in the gap between the contact tab 52 and the inner conductor 64 of the first output port 22 electrically isolates the contact tab 52 from the inner conductor 64. Thus, electrical current does not flow between the inner conductor 34 of the input port 20 and the inner conductor 64 of the first output port 22 when the contact tab 52 is in its open position, and the first electronic device is electrically isolated from the second electronic device.

The electrically-insulative third portion 90 of the arm 82*a* electrically isolates the fourth portion 92 of the arm 82*a* and the adjoining contact tab 52 from the second portion 88 of the of the arm 82*a*, thereby isolating the signal path within the switch 10 from the first and second portions 86, 88 of the arm 82*a*, and the base 80. The third portion 90 can be formed from a suitable dielectric material such as polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the switch 10 as discussed below.

Figure 3B:
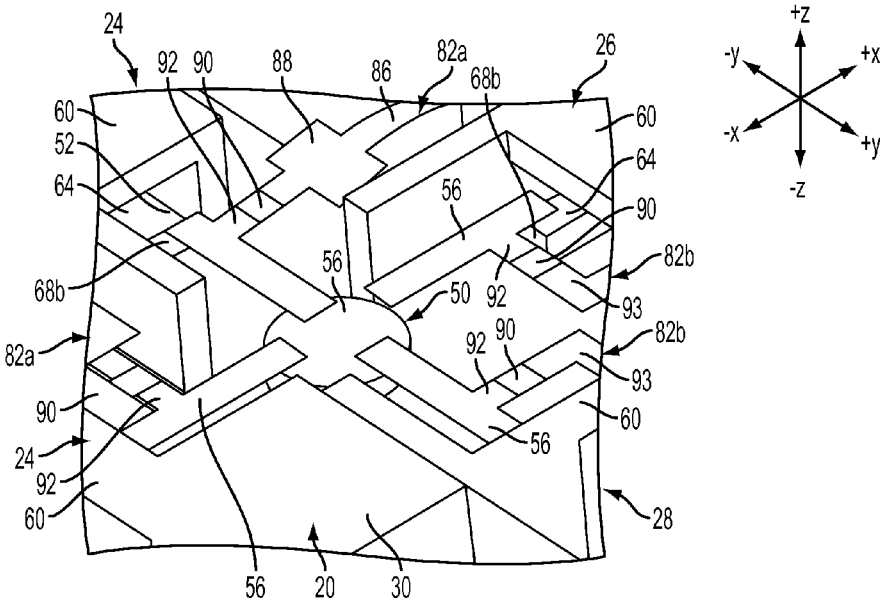
FIG. 3B is a magnified view of the area designated "A" in FIG. 1, depicting one of the contact tabs in its closed position.
Figure 4B:
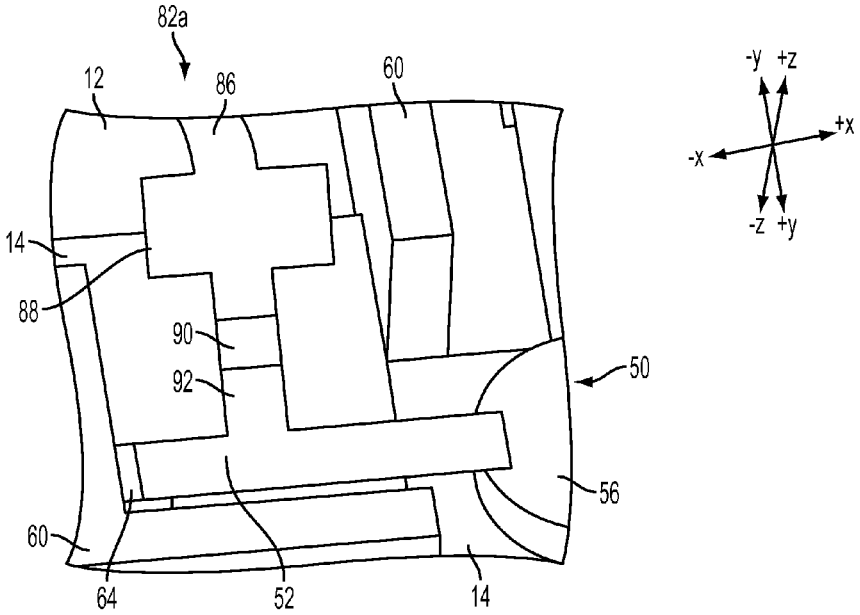
FIG. 4B is a magnified view of the area designated "B" in FIG. 1, depicting one of the contact tabs in its closed position.
Figure 5:
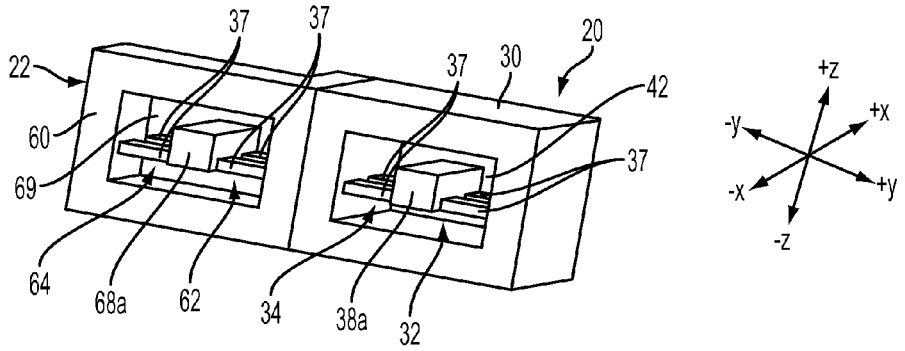
FIGS. 5 and 6 are magnified views of the area designated "C" in FIG. 1.
Figure 6:
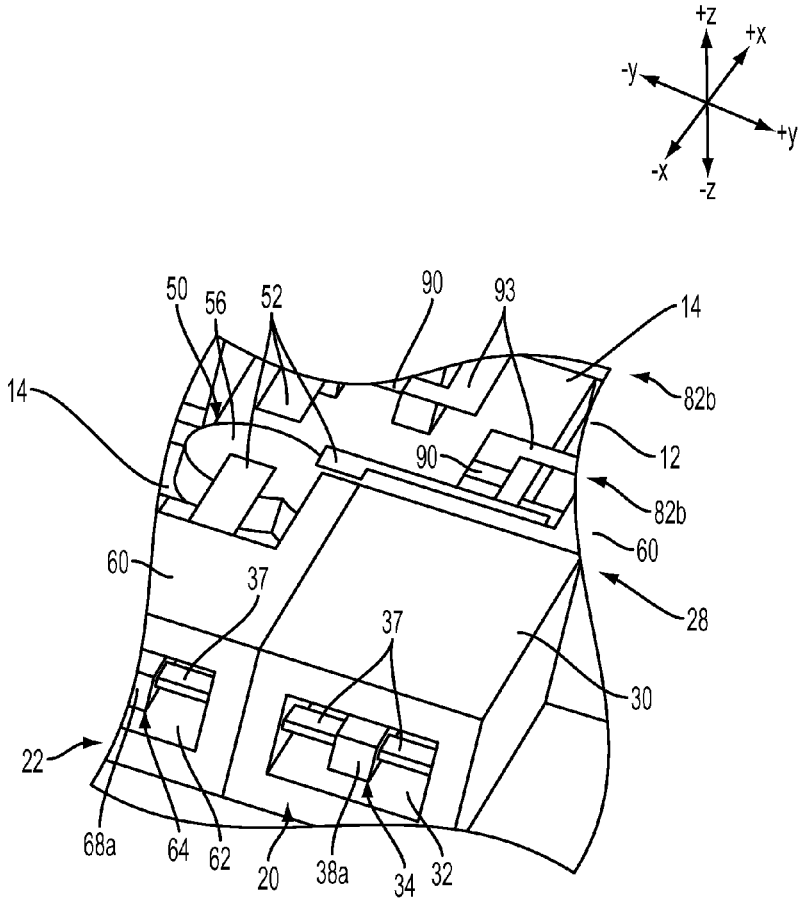

A first end of the contact tab 52 contacts an upper surface of the contact portion 56 of the hub 50 when the contact tab 52 is in the closed position, as depicted in FIGS. 3B and 4B. A second end of the contact tab 52 contacts an upper surface of the inner conductor 64 of the first output port 22 when the contact tab 52 is in the closed position. The noted contact between the contact tab 52, the hub 50, and the inner conductor 64 establishes electrical contact between the first output port 22 and the input port 20. Electric current can thus flow through the switch 10 via a signal path formed by the inner conductor 34 of the input port 20; the hub 50; the contact tab 52 associated with the first actuator 70, and the inner conductor 64 of the first output port 22, thereby establishing electrical contact between the first and second electronic devices.

The magnitude of the respective air gaps between the contact tab 52 and the inner conductor 64 and hub 50 can be, for example, approximately 65 μm. The optimal value for the magnitude of the air gaps is application-dependent, and can vary with factors such as the stiffness, dimensions, and shape of the arm 82*a*, the magnitude of the shock and vibrations to which the switch 10 will be exposed, and the properties, e.g., Young's modulus, of the material from which the arms 82*a* are formed, etc.

The arm 82*a* deflects to facilitate movement of the associated contact tab 52 between the open and closed positions. The deflection results primarily from electrostatic attraction between the second portion 88 of the arm 82*a* and the underlying portion of the ground plane 14, which occurs as follows.

An end of the first portion 86 of the arm 82*a* adjoins the base 80 of the first actuator 70, and is thus rigidly constrained by the base 80, as shown in FIGS. 1 and 8. The base 80 of the first actuator 70 is electrically connected to a voltage source, such as a 120-volt direct current (DC) voltage source (not shown). The second portion 88 of the arm 82*a* is electrically connected to the base 80 by way of the electrically-conductive first portion 86 of the arm 82*a*. Thus, the second portion 88 is subjected to a voltage potential when the first actuator 70 is energized. The electrically-insulative third portion 90 of the arm 82*a* electrically isolates the second portion 88 of the arm 82*a* from the fourth portion 92 of the arm 82*a* and the adjoining contact tab 52. Thus, the base 80 and the first and second portions of the arm 82*a* are energized, and the third and fourth portions of the arm 82*a* are not energized when the base 80 of the first actuator 70 is subjected to a voltage from the voltage source.

The second portion 88 of the arm 82*a*, when energized, acts as an electrode, i.e., an electric field is formed around the second portion 88 due the voltage potential to which the second portion 88 is being subjected. The second portion 88 is positioned above, and thus overlaps the ground plane 14 as shown in FIGS. 1 and 8, and is spaced apart from the ground plane 14 by a gap. The gap is, for example, approximately 65 μm when the arm 82*a* is in an un-deflected state. This gap is small enough so that the portion of the ground plane 14 underlying the second portion 88 is subject to the electrostatic force resulting from the electric field around the second portion 88. The resulting electrostatic attraction between the second portion 88 and the neutral ground plane 14 causes the second portion 88 to be drawn toward the ground plane 14, which in turn causes the associated contact tab 52 to move to its closed position. As shown in FIGS. 1 and 3A-4B, the second portion 88 has a relatively large width, i.e., y-direction dimension, over a majority of its length in comparison to the other portions of the arm 82*a*. Increasing the surface area of the second portion 88 in this manner helps to increase the electrostatic force associated with the second portion 88.

The arm 82*a* is configured to bend so as to facilitate the above-noted movement of the second portion 88 toward the ground plane 14. The voltage applied to the actuator 70, or "pull-in voltage," should be sufficient to cause the arm 82*a* to undergo snap-through buckling, which helps to establish secure contact between the contact tab 52 and the hub 50 and inner conductor 64 when the contact tab 52 is in its closed position. For example, it is estimated that a pull-in voltage of approximately 129.6 volts is needed to achieve the exemplary 65 μm deflection of the contact tab 52 in the switch 10. The optimal pull-in voltage is application-dependent, and can vary with factors such as the required deflection of the contact tab 52, the stiffness, dimensions, and shape of the arms 82*a*, the properties, e.g., Young's modulus, of the material from which the arms 82*a* are formed etc.

Moreover, the length, width, and height of the beam 82*a* can be selected so that the beam 82*a* has a requisite level of stiffness to withstand the levels of shock and vibration to which the switch 10 will be subjected to, without necessitating an inordinately high pull-in voltage. The configuration of the beam 82*a* should be selected so that the deflection of the beam 82*a* remains within the elastic region. This characteristic is necessary to help ensure that the beam 82*a* will return to its un-deflected position when the voltage potential is removed, thereby allowing the contact tab 52 to move to its open position and thereby switch off the associated signal path.

The second actuator 72 is substantially identical to the first actuator 70. The third and fourth actuators 74, 76 are substantially similar to the first actuator 70, with the exception of the shape of the arms 82*b* of the third and fourth actuators 74, 76. As shown in FIG. 1, the arms 82*b* each have a fifth portion 93 to accommodate the specific geometry of the switch 10 proximate the third and fourth actuators 74, 76.

The first, second, third, and fourth actuators 70, 72, 74, 76 can have configurations other than those described above in alternative embodiments. For example, suitable comb, plate, or other types of electrostatic actuators can be used in the alternative. Moreover, actuators other than electrostatic actuators, such as thermal, magnetic, and piezoelectric actuators, can also be used in the alternative.

Alternative embodiments of the switch 10 can be configured to electrically connect one electronic device to one, two, or three, or more than four other electronic devices, i.e., alternative embodiments can be configured with one, two, three, or more than four output ports 22, 24, 26, 28, actuators 70, 72, 74, 76, and contact tabs 52. In alternative embodiments which include only one output port 22, i.e., embodiments in which the switch is used to electrically connect only two electronic components, the hub 50 can be eliminated and the switch can be configured so that the contact tab 52 moves into and out of direct physical contact with the electrical conductors 34, 64 of the respective input port 20 and output port 22.

Electrical isolation of the signal path through the switch 10 is achieved by way of the air gaps 42 between the inner conductor 34 of input port 20 and the interior surfaces of the ground housing 30; the air gaps 62 between the inner conductors 64 of output ports 22 and the interior surfaces of the ground housings 60; and the third portion 90 of the arm 82*a*. The electrical isolation is believed to result in very favorable signal-transmission characteristics for the switch 10. For example, based on finite element method (FEM) simulations, the insertion loss of the switch 10 at 20 GHz is predicted to be approximately 0.12 dB, which is believed to be an improvement of at least approximately 85% over the best in class switches of comparable capabilities. The return loss of the switch 10 at 20 GHz is predicted to be approximately 17.9 dB, which is believed to be an improvement of at least approximately 79% over the best in class switches of comparable capabilities. The isolation of the switch 10 at 20 GHz is predicted to be approximately 46.8 dB, which is believed to be an improvement of at least approximately 17% over the best in class switches of comparable capabilities.

Moreover, because the switch 10 incorporates a relatively large amount of copper in comparison to other types of MEMS switches, which typically are based on thin-film technologies, the switch 10 is believed to have to have substantially higher power-handling capability and linearity, with respect to the transmission of both DC and RF signals, than other types of switches of comparable size. Also, the configuration of the switch 10 makes it capable of being monolithically integrated into systems through the routing of microcoax lines. Moreover, the switch 10 can be fabricated or transferred onto a suite of various exotic substrates.

The switch 10 and alternative embodiments thereof can be manufactured using known processing techniques for creating three-dimensional microstructures, including coaxial transmission lines. For example, the processing methods described in U.S. Pat. Nos. 7,898,356 and 7,012,489, the disclosure of which is incorporated herein by reference, can be adapted and applied to the manufacture of the switch 10 and alternative embodiments thereof.

The switch 10 can be formed in accordance with the following process which is depicted in FIGS. 9A-20B. The first layer of the electrically conductive material forms the ground plane 14, and a portion of the base 80 of each of the first, second, third, and fourth actuators 70, 72, 74, 76. A first photoresist layer (not shown) can be patterned on the upper surface of the substrate 12 utilizing a suitable technique such as a mask, so that the only exposed portions of the upper surface correspond to the locations at which the ground plane 12, and first, second, third, and fourth actuators 70, 72, 74, 76 are to be located. The first photoresist layer is formed, for example, by patterning photodefinable, or photoresist material on the upper surface of the substrate 12 utilizing a mask or other suitable technique.

Electrically-conductive material can subsequently be deposited on the unmasked or exposed portions of the substrate 12, i.e., on the portions of the substrate 12 not covered by the photoresist material, to a predetermined thickness, to form the first layer of the electrically-conductive material as shown in FIGS. 9A and 9B. The deposition of the electrically-conductive material can be accomplished using a suitable technique such as chemical vapor deposition (CVD). Other suitable techniques, such as physical vapor deposition (PVD), can be used in the alternative. The upper surfaces of the newly-formed first layer can be planarized using a suitable technique such as chemical-mechanical planarization (CMP).

The second layer of the electrically conductive material forms portions of the sides of the ground housings 30, 60; and another portion of the bases 80 of the first, second, third, and fourth actuators 70, 72, 74, 76. A second photoresist layer 100 can be applied to the partially-constructed switch 10 by patterning additional photoresist material in the desired shape of the second photoresist layer 100 over the partially-constructed switch 10 and over the first photoresist layer, utilizing a mask or other suitable technique, so that so that the only exposed areas on the partially-constructed switch 10 correspond to the locations at which the above-noted components are to be located, as shown in FIGS. 10A and 10B. The electrically-conductive material can subsequently be deposited on the exposed portions of the switch 10 to a predetermined thickness, to form the second layer of the electrically-conductive material as shown in FIGS. 11A and 11B. The upper surfaces of the newly-formed portions of the switch 10 can then be planarized.

The dielectric material that forms the tabs 37 can be deposited and patterned on top of the previously-formed photoresist layer as shown in FIGS. 12A and 12B. The third layer of the electrically conductive material forms additional portions of the sides of the ground housing 30, 60; the contact portion 56 and the transition portion 58 of the hub 50; another portion of the bases 80 of the first, second, third, and fourth actuators 70, 72, 74, 76; and the inner conductors 34, 64. A third photoresist layer 104 can be applied to the partially-constructed switch 10 by patterning additional photoresist material in the desired shape of the third photoresist layer 104 over the partially-constructed switch 10 and over the second photoresist layer 100, utilizing a mask or other suitable technique, so that so that the only exposed areas on the partially-constructed switch 10 correspond to the locations at which the above-noted components are to be located, as shown in FIGS. 13A and 13B. The electrically-conductive material can subsequently be deposited on the exposed portions of the switch 10 to a predetermined thickness, to form the third layer of the electrically-conductive material as shown in FIGS. 14A and 14B. The upper surfaces of the newly-formed portions of the switch 10 can then be planarized.

The fourth layer of the electrically conductive material forms additional portions of the sides of the ground housings 30, 60, and additional portions of the bases 80 of the first, second, third, and fourth actuators 70, 72, 74, 76. The fourth layer is formed in a manner similar to the first, second, and third layers. In particular, the fourth layer is formed by patterning additional photoresist material to the previously-formed layers, utilizing a mask or other suitable technique, to form a fourth photoresist layer 106, as shown in FIGS. 15A and 15B, and then depositing additional electrically-conductive material to the exposed areas to form the fourth layer of the electrically conductive material as shown in FIGS. 16A and 16B. The upper surfaces of the newly-formed portions of the switch 10 can be planarized after the application of the fourth layer.

The fifth layer of the electrically conductive material forms additional portions of the sides of the ground housings 30, 60, additional portions of the bases 80 of the first, second, third, and fourth actuators 70, 72, 74, 76; the arms 82*a*, 82*b* of the first, second, third, and fourth actuators 70, 72, 74, 76; and the contact tabs 52. The dielectric material that forms the third portion 90 of the arm 82*a* of each of the first, second, third, and fourth actuators 70, 72, 74, 76 can be deposited and patterned on top of the previously-formed photoresist layer as shown in FIGS. 17A and 17B. The remainder of the fifth layer is formed in a manner similar to the first, second, third, and fourth layers. In particular, the remainder of the fifth layer is formed by patterning additional photoresist material to the previously-formed layers, utilizing a mask or other suitable technique, to form a fifth photoresist layer 106 as shown in FIGS. 18A and 18B, and then depositing additional electrically-conductive material to the exposed areas to form the fifth layer of the electrically conductive material as shown in FIGS. 19A and 19B. The upper surfaces of the newly-formed portions of the switch 10 can be planarized after the application of the fifth layer.

The photoresist material remaining from each of the masking steps can be removed or released after application of the fifth layer has been completed as depicted in FIGS. 20A and 20B, for example, by exposing the photoresist material to an appropriate solvent that causes the photoresist material to evaporate or dissolve.

What is claimed is:

1. A switch, comprising:

an electrically-conductive first housing;

a first electrical conductor suspended within and electrically isolated from the electrically-conductive first housing;

an electrically-conductive second housing;

a second electrical conductor suspended within and electrically isolated from the electrically-conductive second housing;

a third electrical conductor moving between a first position at which the third electrical conductor is electrically isolated from the first and second electrical conductors, and a second position at which the third electrical conductor is in electrical contact with the first and second electrical conductors;

a first actuator comprising an electrically-conductive base and an electrically-conductive arm having a first end restrained by the electrically-conductive base, wherein the third electrical conductor is supported by the electrically-conductive arm, and the electrically-conductive arm deflects and moves the third electrical conductor between the first and second positions; and an electrically-conductive hub permanently connected to the first electrical conductor and selectively electrically connectable to the second electrical conductor via transitions of the third electrical conductor to and from the first and second positions.

2. The switch of claim 1, further comprising:

an electrically-insulative substrate; and a ground plane disposed on the electrically-insulative substrate;

wherein the electrically-conductive first and second housings are in electrical contact with the ground plane, and the electrically-conductive base of the first actuator is disposed on the electrically-insulative substrate.

3. A switch, comprising:

an electrically-conductive first housing;

a first electrical conductor suspended within and electrically isolated from the electrically-conductive first housing;

an electrically-conductive second housing;

a second electrical conductor suspended within and electrically isolated from the electrically-conductive second housing;

a third electrical conductor moving between a first position at which the third electrical conductor is electrically isolated from the first and second electrical conductors, and a second position at which the third electrical conductor is in electrical contact with the first and second electrical conductors;

a first actuator comprising an electrically-conductive base and an electrically-conductive arm having a first end restrained by the electrically-conductive base, wherein the third electrical conductor is supported by the electrically-conductive arm, and the electrically-conductive arm deflects and moves the third electrical conductor between the first and second positions;

an electrically-insulative substrate;

a ground plane disposed on the electrically-insulative substrate; and an electrically-conductive hub to which the first electrical conductor is electrically connected;

wherein the electrically-conductive first and second housings are in electrical contact with the ground plane, and the electrically-conductive base of the first actuator is disposed on the electrically-insulative substrate; and wherein the third electrical conductor is spaced apart from the electrically-conductive hub and the second electrical conductor when the third electrical conductor is in the first position, and the third electrical conductor contacts the electrically-conductive hub and the second electrical conductor when the third electrical conductor is in the second position.

4. The switch of claim 3, further comprising:

an electrically-conductive third housing;

a forth electrical conductor suspended within and electrically isolated from the electrically-conductive third housing;

a fifth electrical conductor moving between a first position at which the fifth electrical conductor is spaced apart from the electrically-conductive hub and the fourth electrical conductor, and a second position at which the fifth electrical conductor contacts the electrically-conductive hub and the fourth electrical conductor; and a second actuator comprising an electrically-conductive base and an electrically-conductive arm having a first end restrained by the electrically-conductive base of the second actuator, wherein the fifth electrical conductor is supported by the electrically-conductive arm of the second actuator, and the electrically-conductive arm of the second actuator deflects and moves the fifth electrical conductor between the first and second positions of the fifth electrical conductor.

5. The switch of claim 3, further comprising:

an electrically-conductive fourth housing;

a sixth electrical conductor suspended within and electrically isolated from the electrically-conductive fourth housing;

a seventh electrical conductor moving between a first position at which the seventh electrical conductor is spaced apart from the electrically-conductive hub and the sixth electrical conductor, and a second position at which the seventh electrical conductor contacts the electrically-conductive hub and the sixth electrical conductor; and a third actuator comprising an electrically-conductive base and an electrically-conductive arm having a first end restrained by the electrically-conductive base of the third actuator, wherein the seventh electrical conductor is supported by the electrically-conductive arm of the third actuator, and the electrically-conductive arm of the third actuator deflects and moves the seventh electrical conductor between the first and second positions of the seventh electrical conductor.

6. The switch of claim 5, further comprising:

an electrically-conductive fifth housing;

an eighth electrical conductor suspended within and electrically isolated from the electrically-conductive fifth housing;

a ninth electrical conductor moving between a first position at which the ninth electrical conductor is spaced apart from the electrically-conductive hub and the eighth electrical conductor, and a second position at which the ninth electrical conductor contacts the electrically-conductive hub and the eighth electrical conductor; and a fourth actuator comprising an electrically-conductive base and an electrically-conductive arm having a first end restrained by the electrically-conductive base of the fourth actuator, wherein the ninth electrical conductor is supported by the electrically-conductive arm of the fourth actuator, and the electrically-conductive arm of the fourth actuator deflects and moves the ninth electrical conductor between the first and second positions of the ninth electrical conductor.

7. The switch of claim 1, wherein the third electrical conductor adjoins a second end of the electrically-conductive arm.

8. The switch of claim 1, wherein:

the electrically-conductive arm comprises an electrically conductive first portion located adjacent the electrically-conductive base, and an electrically conductive second portion located adjacent the first portion, the second portion facing and being spaced apart above a ground plane; and the second portion, when subjected to a voltage potential, is operative to develop an electrostatic force that attracts the second portion toward the ground plane thereby causing the third electrical conductor to move from the first to the second position.

9. The switch of claim 8, wherein the electrically-conductive arm bends in response to the attraction of the second portion of the electrically-conductive arm toward the ground plane.

10. The switch of claim 8, wherein the electrically-conductive arm further comprises an electrically-insulative third portion located adjacent the second portion, and an electrically-conductive fourth portion located adjacent the third portion of the electrically-conductive arm and the third electrical contact.

11. The switch of claim 10, wherein:

the first portion of the electrically-conductive arm adjoins and is restrained by the electrically-conductive base;

the second portion of the electrically-conductive arm adjoins the first portion of the electrically-conductive arm;

the third portion of the electrically-conductive arm adjoins the second portion of the electrically-conductive arm;

the fourth portion of the electrically-conductive arm adjoins the third portion of the electrically-conductive arm and the third electrical conductor.

12. The switch of claim 1, wherein the first and second electrical conductors each have a substantially rectangular cross section, and the third electrical conductor is a tab.

13. The switch of claim 2, wherein the ground plane, the electrically-conductive first and second housings, the first electrical conductor, the second electrical conductor, the third electrical conductor, and the actuator comprise layers of an electrically-conductive material.

14. A switch, comprising:

an electrically-insulative substrate;

a first, second, and third electrical conductor;

an electrically-conductive hub electrically connected to the first electrical conductor; and an actuator comprising a base disposed on the electrically-insulative substrate, and an arm having a first end restrained by the base, and a second end that adjoins the third electrical conductor;

wherein the third electrical conductor moves between a first position at which the third electrical conductor is spaced apart from the electrically-conductive hub and the second electrical conductor, and a second position at which the third electrical conductor contacts the electrically-conductive hub and the second electrical conductor; and wherein the arm deflects toward the substrate and thereby moves the third electrical conductor from the first to the second position.

15. The switch of claim 14, further comprising:

a fourth and fifth electrical conductor; and a second actuator comprising a base disposed on the electrically-insulative substrate, and an arm having a first end restrained by the base of the second actuator, and a second end that adjoins the fifth electrical conductor;

wherein the fifth electrical conductor moving between a first position at which the fifth electrical conductor is spaced apart from the electrically-conductive hub and fourth electrical conductor, and a second position at which the fifth electrical conductor contacts the electrically-conductive hub and the fourth electrical conductor; and wherein the arm of the second actuator deflects toward the substrate and thereby moves the fifth electrical conductor from the first to the second position of the fifth electrical conductor.

16. The switch of claim 14, further comprising a ground plane disposed on the electrically-insulative substrate; and a first and second electrically-conductive housing in electrical contact with the ground plane;

wherein the first electrical conductor is positioned within the first electrically-conductive housing and is spaced apart from adjacent surfaces of the first electrically-conductive housing by a first air gap; and wherein the second electrical conductor is positioned within the second electrically-conductive housing and is spaced apart from adjacent surfaces of the second electrically-conductive housing by a second air gap.

17. The switch of claim 14, wherein the arm comprises an electrically conductive first portion that adjoins the base, an electrically conductive second portion that adjoins the first portion, an electrically insulative third portion that adjoins the second portion, and an electrically conductive fourth portion that adjoins the third portion and the third electrical conductor.

18. The switch of claim 17, further comprising:

a ground plane disposed on the electrically-insulative substrate;

wherein the second portion of the arm faces and is spaced apart from the ground plane; and wherein the second portion, when subjected to a voltage potential, is operative to develop an electrostatic force that attracts the second portion of the arm toward the ground plane thereby causing the third electrical conductor to move from the first to the second position.

19. The switch of claim 18, wherein the arm is configured to bends in response to the attraction of the second portion of the arm toward the ground plane.

20. The switch of claim 16, wherein the ground plane, the electrically-conductive hub, the first and second electrically-conductive housings, the first electrical conductor, the second electrical conductor, the third electrical conductor, and the actuator comprise layers of an electrically-conductive material.

* * * * *